US011774877B2

(12) United States Patent
Park et al.

(10) Patent No.: US 11,774,877 B2
(45) Date of Patent: Oct. 3, 2023

(54) DEVELOPER CARTRIDGE INCLUDING STRUCTURE FOR DETECTING DEVELOPER END

(71) Applicant: HEWLETT-PACKARD DEVELOPMENT COMPANY, L.P., Spring, TX (US)

(72) Inventors: Jonghyun Park, Seongnam-si (KR); Seil Kwon, Seongnam-si (KR); Jeonghyun Lee, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/792,779

(22) PCT Filed: Nov. 20, 2020

(86) PCT No.: PCT/US2020/061576
§ 371 (c)(1),
(2) Date: Jul. 14, 2022

(87) PCT Pub. No.: WO2022/005508
PCT Pub. Date: Jan. 6, 2022

(65) Prior Publication Data

US 2023/0039181 A1 Feb. 9, 2023

(30) Foreign Application Priority Data

Jun. 30, 2020 (KR) ..... 10-2020-0080436

(51) Int. Cl.
*G03G 15/10* (2006.01)
*G03G 15/08* (2006.01)

(52) U.S. Cl.
CPC ..... *G03G 15/0856* (2013.01)

(58) Field of Classification Search
CPC ..... G03G 15/0856; G03G 15/10; G03G 15/20
USPC ..... 399/58, 61, 119, 120, 252, 258, 262
See application file for complete search history.

(56) References Cited

U.S. PATENT DOCUMENTS

| | | | | |
|---|---|---|---|---|
| 6,151,472 | A | 11/2000 | Nakajima | |
| 8,989,611 | B2 * | 3/2015 | Leemhuis | G03G 15/086 399/61 |
| 9,298,134 | B2 | 3/2016 | Okubo et al. | |
| 2002/0057924 | A1 | 5/2002 | Ueno et al. | |
| 2008/0025735 | A1 | 1/2008 | Odani | |
| 2009/0074468 | A1 | 3/2009 | Iwata et al. | |
| 2015/0086229 | A1 | 3/2015 | Naruse et al. | |
| 2016/0231664 | A1 | 8/2016 | Kubo | |

FOREIGN PATENT DOCUMENTS

| | | | |
|---|---|---|---|
| EP | 0 952 496 | B1 | 11/2006 |
| JP | 2000-275944 | A | 10/2000 |
| JP | 2018185447 | * | 11/2018 |
| KR | 10-0612216 | B1 | 8/2006 |
| WO | WO-2019/203394 | A1 | 10/2019 |

* cited by examiner

*Primary Examiner* — Hoan H Tran
(74) *Attorney, Agent, or Firm* — Foley & Lardner LLP

(57) ABSTRACT

A developer cartridge includes a housing to accommodate a developer and including a developer outlet, and a sensing portion that forms a sensing area to detect whether or not the developer inside the housing is miming out. The sensing portion is recessed into a portion of a lower wall of the housing accordingly having a thickness less than a thickness of a remaining portion of the lower wall.

15 Claims, 12 Drawing Sheets

DEVELOPER CARTRIDGE INCLUDING STRUCTURE FOR DETECTING DEVELOPER END

BACKGROUND

An electro-photographic image forming apparatus forms a visible toner image on a photoconductor by supplying a toner to an electrostatic latent image formed on the photoconductor, transfers the toner image onto a print medium directly or via an intermediate transfer medium, and then fuses the transferred toner image on the print medium.

A developer is accommodated in a replaceable developer cartridge. The developer cartridge is replaced when the developer accommodated therein runs out. The time when a developer cartridge is replaced may be determined by detecting a developer level in the developer cartridge. The developer level in the developer cartridge may be predicted by calculating developer consumption. The developer consumption may be predicted through the number of printed pixels, a driving time of a motor for supplying a developer to the body of a printer, or the like.

DETAILED DESCRIPTION

An electro-photographic image forming apparatus is provided with a replaceable developer cartridge that accommodates a developer. To determine when a developer cartridge is to be replaced, a level of a developer remaining in the developer cartridge may be detected. The developer level may be detected in an indirect method in that an amount of developer consumption may be predicted and the developer level may be detected based on the predicted amount of developer consumption. In such a method, if the predicted amount of developer consumption differs from an actual amount of developer consumption, an error may occur in determining when to replace the developer cartridge. The developer cartridge may be locked into a body according to a locking structure when mounted on the body. When the developer in the developer cartridge runs out, information such as "developer empty" may be displayed through a user interface or host of the image forming apparatus. The developer cartridge may be unlocked at the same time as the display of the information such as "developer empty", or by a user's operation such that the developer cartridge may be replaced. If the developer level is not correctly detected, the developer cartridge may be replaced although a significant amount of developer is still present in the developer cartridge, or the developer cartridge may not be replaced in time although the developer has run out. In that case, print quality may be poor.

The developer level of the developer cartridge may be directly detected by using a developer level sensor. The developer level sensor may be located on the body of the image forming apparatus to directly detect the developer level of the developer cartridge when the developer cartridge is mounted on the body of the image forming apparatus. The developer cartridge according to the present example has a structure in which the developer level sensor provided on the body of the image forming apparatus may closely approach the developer cartridge to increase the reliability of a detected developer level. Accordingly, it is possible to determine precisely when to replace the developer cartridge. As a result, it is possible to prevent poor printing quality due to the fact that the developer cartridge is not replaced although the developer has run out, and also to prevent wasting costs due to premature replacement of the developer cartridge. In addition, since the developer cartridge may be replaced when the developer has run out, the amount of developer to be discarded may be reduced, which may benefit the environment. The developer cartridge according to the present example may have a structure capable of preventing interference between the developer level sensor and the developer cartridge when the developer cartridge is mounted on the body of the image forming apparatus. Hereinafter, examples of the developer cartridge will be described in detail with reference to the accompanying drawings.

Figure 1:
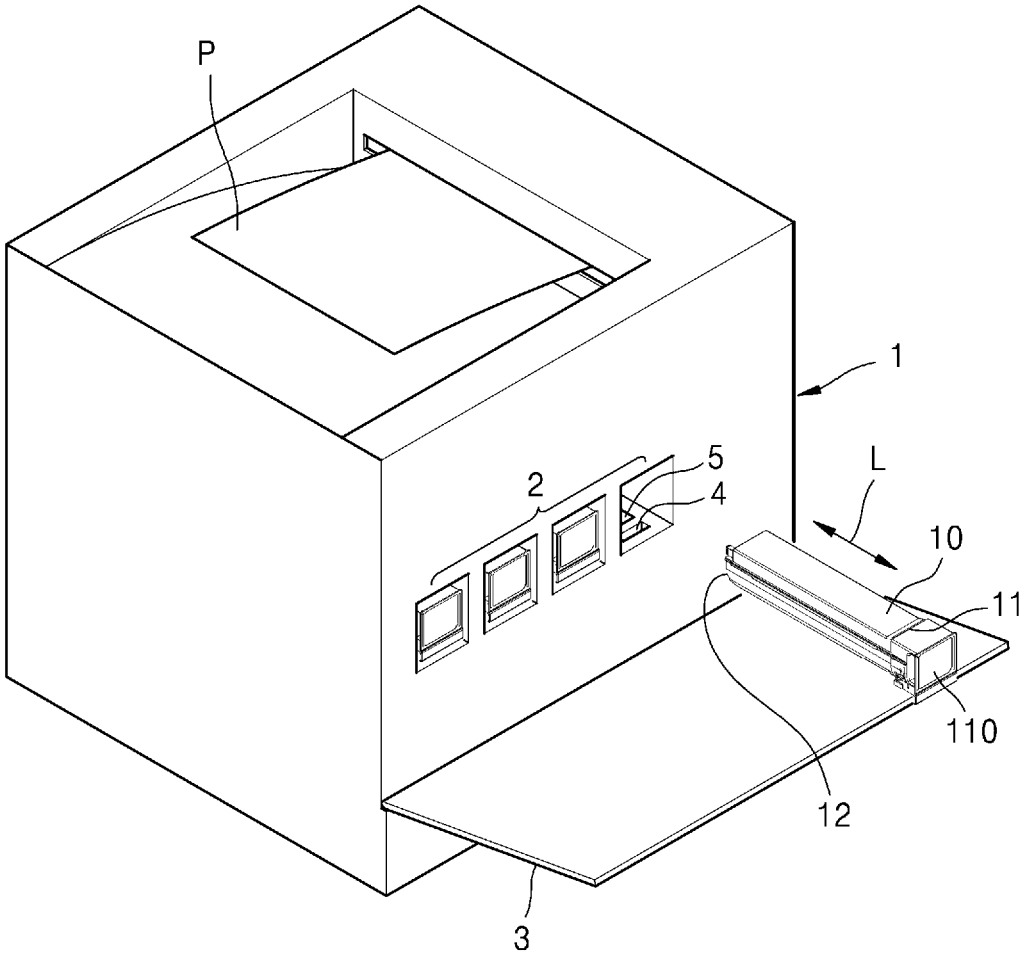
FIG. 1 is a schematic perspective view of an electro-photographic image forming apparatus, according to an example of the present disclosure.

FIG. 1 is a schematic perspective view of an electro-photographic image forming apparatus, according to an example of the present disclosure. Referring to FIG. 1, an image forming apparatus is provided with a body 1, and a developer cartridge 10 that is mounted on or removed from the body 1. The developer cartridge 10 may be referred to as a 'toner cartridge'. The body 1 is provided with a printing portion configured to print an image on a print medium P in an electro-photographic method. The printing portion may be provided with a developing device, an optical scanner, a transfer unit, and a fuser. The developer cartridge 10 accommodates a developer to be supplied to the printing portion. The developer includes a toner and a carrier. The developer accommodated in the developer cartridge 10 is supplied to the developing device. A color image forming apparatus may include, for example, a plurality of developing devices for forming toner images in colors such as cyan (C), magenta (M), yellow (Y), and black (K), and a plurality of developer cartridges 10 in which developers in colors such as C, M, Y, and K are accommodated, respectively.

The developing device may include a photosensitive drum, a charging roller that charges a surface of the photosensitive drum at a uniform electric potential, and a developing roller that supplies a developer onto the surface of the photosensitive drum to form a visible toner image. The optical scanner forms an electrostatic latent image by irradiating light modulated according to image information on the surface of the photosensitive drum charged with a uniform electric potential. The electrostatic latent image is developed into a visible toner image by a toner supplied by the developing roller. The transfer unit transfers the toner image from the surface of the photosensitive drum onto the print medium P. The print medium P onto which the toner image is transferred is subjected to heat and pressure while passing through the fuser. The toner image is fused onto the print medium P by the heat and pressure.

The developer cartridge 10 may be mounted on or separated from the body 1. When the developer accommodated in the developer cartridge 10 runs out, the developer cartridge 10 may be replaced with a new developer cartridge 10. The body 1 may be provided with a mounting portion 2 on which the developer cartridge 10 is mounted. A door 3 opens or closes a portion of the body 1 such that the developer cartridge 10 is mounted on, or separated from, the body 1. The mounting portion 2 is provided with a developer inlet 4 and a developer level sensor 5.

Figure 2:
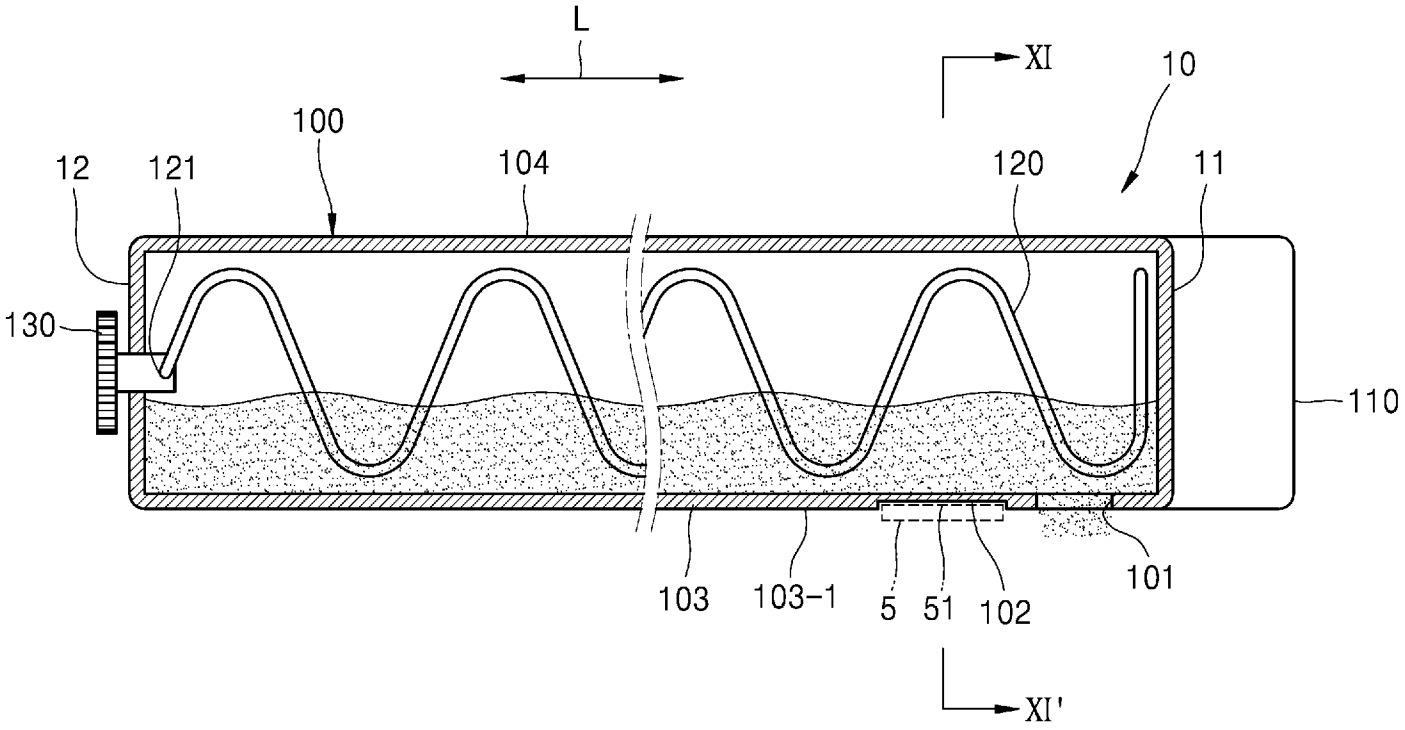
FIG. 2 is a schematic cross-sectional view of a developer cartridge, according to an example.
Figure 3:
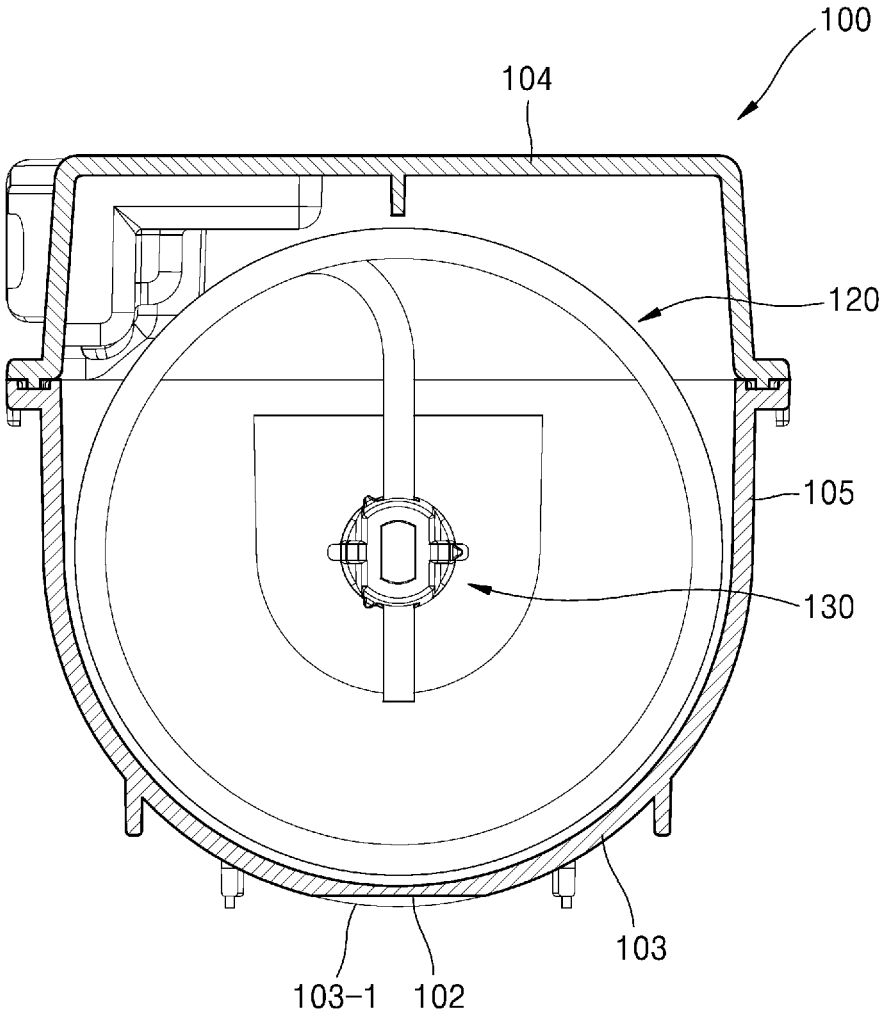
FIG. 3 is a cross-sectional view taken along line X1-X1' in the example of FIG. 2.

FIG. 2 is a schematic cross-sectional view of the developer cartridge 10, according to an example, and FIG. 3 is a cross-sectional view taken along line X1-X1' in the example of FIG. 2. Referring to FIGS. 2 and 3, the developer cartridge 10 may include a housing 100 where a developer is accommodated and a developer outlet 101 is provided, and a sensing portion 102 that forms a sensing area for detecting a developer level inside the housing 100 and is recessed into a portion of the lower wall 103 of the housing 100 accordingly having a thickness less than a thickness of a remaining portion of the lower wall 103.

The housing 100 extends in a lengthwise direction L. A transport member 120 is installed inside the housing 100 to transport the developer to the developer outlet 101. The transport member 120 transports the developer in the lengthwise direction L toward the developer outlet 101. The transport member 120 according to the present example includes a spiral coil. The spiral coil may be referred to as a spring auger. A power transmission member 130 is installed at one end portion of the housing 100 in the lengthwise direction L. One end portion 121 of the transport member 120 is connected to the power transmission member 130. The power transmission member 130 may include, for example, a gear, a coupler, or the like. When the developer cartridge 10 is mounted on the mounting portion 2, the power transmission member 130 may be connected to a developer supply motor (not shown) provided on the body 1.

The housing 100 includes a front end portion 11, and a rear end portion 12 which is an end portion opposite to the front end portion 11, in the lengthwise direction L. The developer cartridge 10 is inserted into the mounting portion 2 from the rear end portion 12. A front cover 110 on which a handle that a user may hold is provided may be coupled to the front end portion 11. The housing 100 includes the lower wall 103, an upper wall 104, and a side wall 105 that connects the lower wall 103 to the upper wall 104. The developer is loaded from the lower wall 103 toward the upper wall 104 inside the housing 100. The transport member 120 rotates around a rotation axis extending in the lengthwise direction L, Therefore, a cross-sectional shape orthogonal to the lengthwise direction L of the lower wall 103 may be a round shape. For example, the cross-sectional shape orthogonal to the lengthwise direction L of the lower wall 103 may be a partial arc shape centered on a rotation axis of the transport member 120.

The developer outlet 101 is formed on the lower wall 103. The developer outlet 101 is located adjacent to any one of both end portions in the lengthwise direction L of the housing 100. According to the present example, the developer outlet 101 is located adjacent to the front end portion 11. Although not shown, the developer cartridge 10 may include a shutter for opening and closing the developer outlet 101. With the developer cartridge 10 removed from the body 1, the shutter is located at a position blocking the developer outlet 101, The shutter may be moved to a position to open the developer outlet 101 in conjunction with a mounting operation of the developer cartridge 10 on the mounting portion 2. When the developer cartridge 10 is mounted on the mounting portion 2, the developer outlet 101 faces the developer inlet 4 provided at the mounting portion 2. The developer transported in the lengthwise direction L by the transport member 120 falls to the developer inlet 4 by gravity.

The sensing portion 102 forms a sensing area for detecting a developer level. The sensing portion 102 is recessed into the lower wall 103. That is, the sensing portion 102 is a portion recessed into an outer surface 103-1 of the lower wall 103 accordingly having a reduced thickness as compared to the remaining portion of the lower wall 103. That is, the thickness of the sensing portion 102 is less than a thickness of the remaining portion of the lower wall 103. The sensing portion 102 may be flat. That is, the sensing portion 102 may have a flat surface. When the developer cartridge 10 is mounted on the mounting portion 2, the developer level sensor 5 faces the sensing portion 102. A sensing surface 51 of the developer level sensor 5 may be in contact with the sensing portion 102, or may be spaced slightly apart from the sensing portion 102. The sensing surface 51 of the developer level sensor 5 may be in contact with the sensing portion 102 beyond the outer surface 103-1 of the lower wall 103, and may be spaced slightly apart from the sensing portion 102. The sensing surface 51 of the developer level sensor 5 may be located adjacent to the sensing portion 102 without exceeding the outer surface 103-1 of the lower wall 103.

The sensing portion 102 may be aligned with the developer outlet 101 in the lengthwise direction L. The sensing portion 102 is located adjacent to the developer outlet 101 in the lengthwise direction L. The sensing portion 102 is located at a position at which the sensing portion 102 is able to correctly detect whether or not the developer inside the housing 100 is running out. The sensing portion 102 is located on an upstream side of the developer outlet 101, based on a direction in which the developer is transported by the transport member 120.

Figure 4:
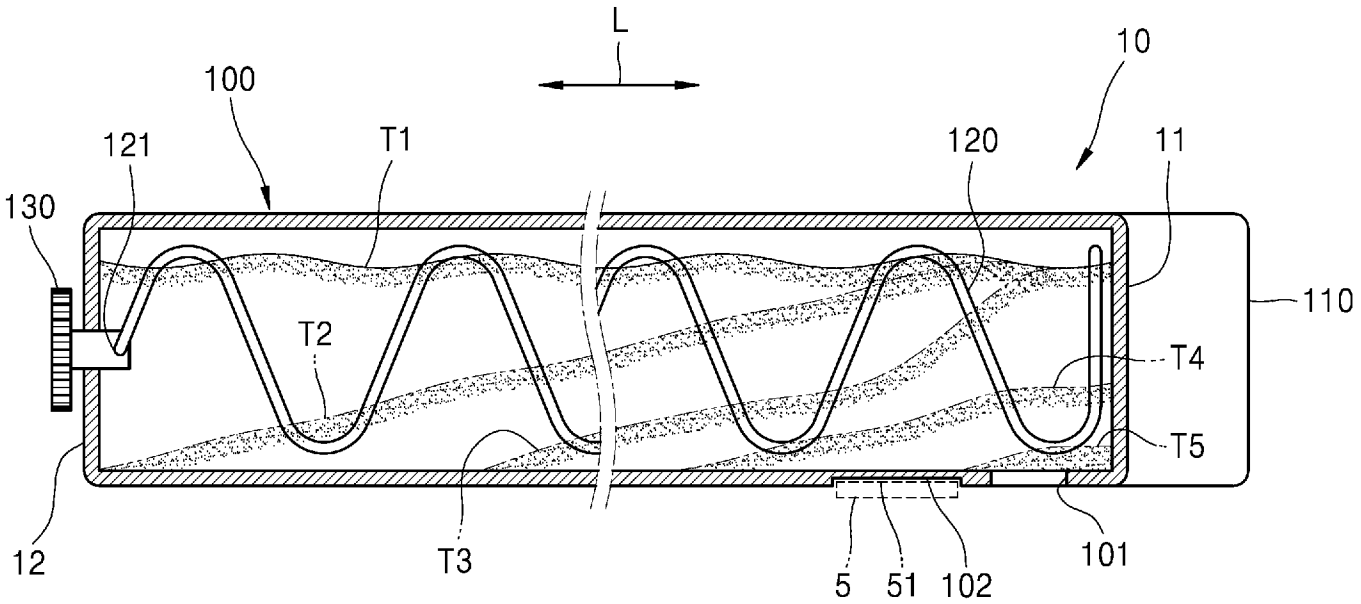
FIG. 4 is a diagram illustrating an example of a process of determining the location of a sensing portion.

FIG. 4 is a diagram illustrating an example of a process of determining a location of the sensing portion 102. Referring to FIG. 4, the distribution of developer accommodated inside of the housing 100 varies as the developer is consumed as indicated by T1, T2, T3, T4, and T5, respectively. With the developer being full, a state in which the developer is accommodated inside the housing 100 is as indicated by a reference numeral T1. Since the developer is transported by the transport member 120 toward the developer outlet 101, the closer to the developer outlet 101, the higher the level of the developer, the farther from the developer outlet 101, the lower the level of the developer as the developer is consumed and the amount of the developer inside the housing 100 is reduced. Therefore, as the developer is consumed and the amount of the developer inside the housing 100 is reduced, the distribution of the developer inside the housing 100 is as indicated by reference numerals T2, T3, T4, and T5, respectively. If the sensing portion 102 is installed adjacent to the developer outlet 101 on the upstream side of the developer outlet 101, the developer level may be detected until the developer inside the housing 100 almost runs out. Thus, it is possible to properly detect when to replace the developer cartridge 10.

A distance from one end portion adjacent to the developer outlet 101 of the housing 100, that is, the front end portion 11 according to the present example to the sensing portion 102 may not exceed ½ of a length of a housing 100 in the lengthwise direction L. As an example, a distance from the front end portion 12 to the sensing portion 102 may be less than or equal to ⅓ of the length of the housing 100 in the lengthwise direction L. As an example, the distance from the front end portion 12 to the sensing portion 102 may be less than or equal to ¼ of the length of the housing 100 in the lengthwise direction L. The location of the sensing portion 102 may be precisely determined to be able to detect whether or not the developer inside the housing 100*b* is running out when the developer inside the housing 100*b* has almost run out.

As shown in FIG. 4, the more the developer is consumed, the lower the level of the developer adjacent to the developer level sensor 5, and an output value of the developer level sensor 5 changes. Through an experiment, a relationship between the developer level and the output value of the developer level sensor 5 may be represented through a look-up table and stored in a storage device, which is not shown. The output value of the developer level sensor 5 may be compared with a pre-stored output value to detect the developer level, and the time when the developer cartridge 10 is replaced may be determined based on the detected developer level.

The developer level may be detected by various methods: The developer level may be detected through the amount of developer consumption based on the number of printed pixels, based on the driving time of a developer supply motor, and based on the number of revolutions of a gear driving a transport member, for example. In the above-described methods, the amount of developer consumption is not actually measured, but the amount of developer consumption is predicted in an indirect method, and the developer level is detected based on the predicted amount of developer consumption. A predicted amount of developer consumption may differ from an actual amount of developer consumption due to factors such as print conditions related to the density of a printed image and the like, and mechanical and control defects related to the supply of the developer. If the predicted amount of developer consumption and the actual amount of developer consumption significantly differ from each other, an error may occur in determining whether to replace a developer cartridge as an error in detecting the developer level increases. For example, if the actual amount of developer consumption is greater than an average amount of developer consumption although the predicted amount of developer consumption is less than the average amount of developer consumption, it may be estimated that an adequate amount of developer is still present even although the developer has already run out. In that case, print errors may occur, or printout may not come out at the right time due to a failure in preparing a new developer cartridge. On the contrary, if the actual amount of developer consumption is less than an average amount of developer consumption although the predicted amount of developer consumption is greater than the average amount of developer consumption, the developer cartridge may be replaced even though an adequate amount of developer is still present.

According to the present example, when the developer cartridge 10 is mounted on the mounting portion 2 of the body 1, the developer level sensor 5 approaches the sensing portion 102 to directly detect the level of the developer in the developer cartridge 10. If the developer level sensor 5 is installed in the developer cartridge 10, a cost of the developer level sensor 5 and a cost incurred in an electrical connection structure for transmitting a detection signal of the developer level sensor 5 to the body 1 of an image forming apparatus are added. Therefore, the developer cartridge 10, which is expendable, may become expensive. According to the present example, the developer level of the developer cartridge 10 may be accurately detected to determine precisely when to replace the developer cartridge 10, and the cost of the developer cartridge 10, which is expendable, may be saved.

The developer level sensor 5 may be of any structure. The developer level sensor 5 may include a circuit for detecting variation in an inductance according to the developer level. For example, the developer level sensor 5 may include an LC circuit. When a conductor approaches a coil of the L-C circuit, an inductance of the LC circuit varies. Since a carrier included in the developer contains an iron component, the inductance of the L-C circuit varies according to the amount of the developer near the developer level sensor 5. Thus, the developer level may be detected by using the variation in the inductance. The closer the sensing surface 51 of the developer level sensor 5 is to the carrier, the more accurately the developer level is detected as sensing sensitivity of the developer level sensor 5 is increased. According to the present example, since the sensing portion 102 is recessed into the lower wall 103, the sensing surface 51 of the developer level sensor 5 may be located close to the developer inside the housing 100.

The greater a thickness of the sensing portion 102, the lower the sensing sensitivity of the developer level sensor 5. Thus, an error may increase in detecting the level of the developer in the developer cartridge 10, Within the developer cartridge 10 according to the present example, the sensing portion 102 is recessed into a portion of the outer surface 103-1 of the lower wall 103 accordingly having a reduced thickness as compared to the remaining portion of the lower wall 103, Therefore, the sensing sensitivity of the developer level sensor 5 may be prevented from being lowered, and the reliability of the detection of the level of the developer in the developer cartridge 10 may be increased.

Since the sensing portion 102 is flat, the sensing surface 51 of the developer level sensor 5 may uniformly approach or contact the sensing portion 102, thus increasing the reliability of the detection of the developer level. In the case where the sensing surface 51 of the developer level sensor 5 uniformly approaches the flat sensing portion 102, the reliability of the detection of the developer level may be increased more than before. For example, a cross-sectional shape orthogonal to the lengthwise direction L of the lower wall 103 may be a round shape, and the sensing portion 102 may be a flat shape recessed into the outer surface 103-1 of the lower wall 103. An inner surface of the sensing portion 102 has the same round shape as an inner surface of the lower wall 103. In that case, a minimum value of the thickness of the sensing portion 102 may be less than or equal to 1.5 mm.

Figure 5:
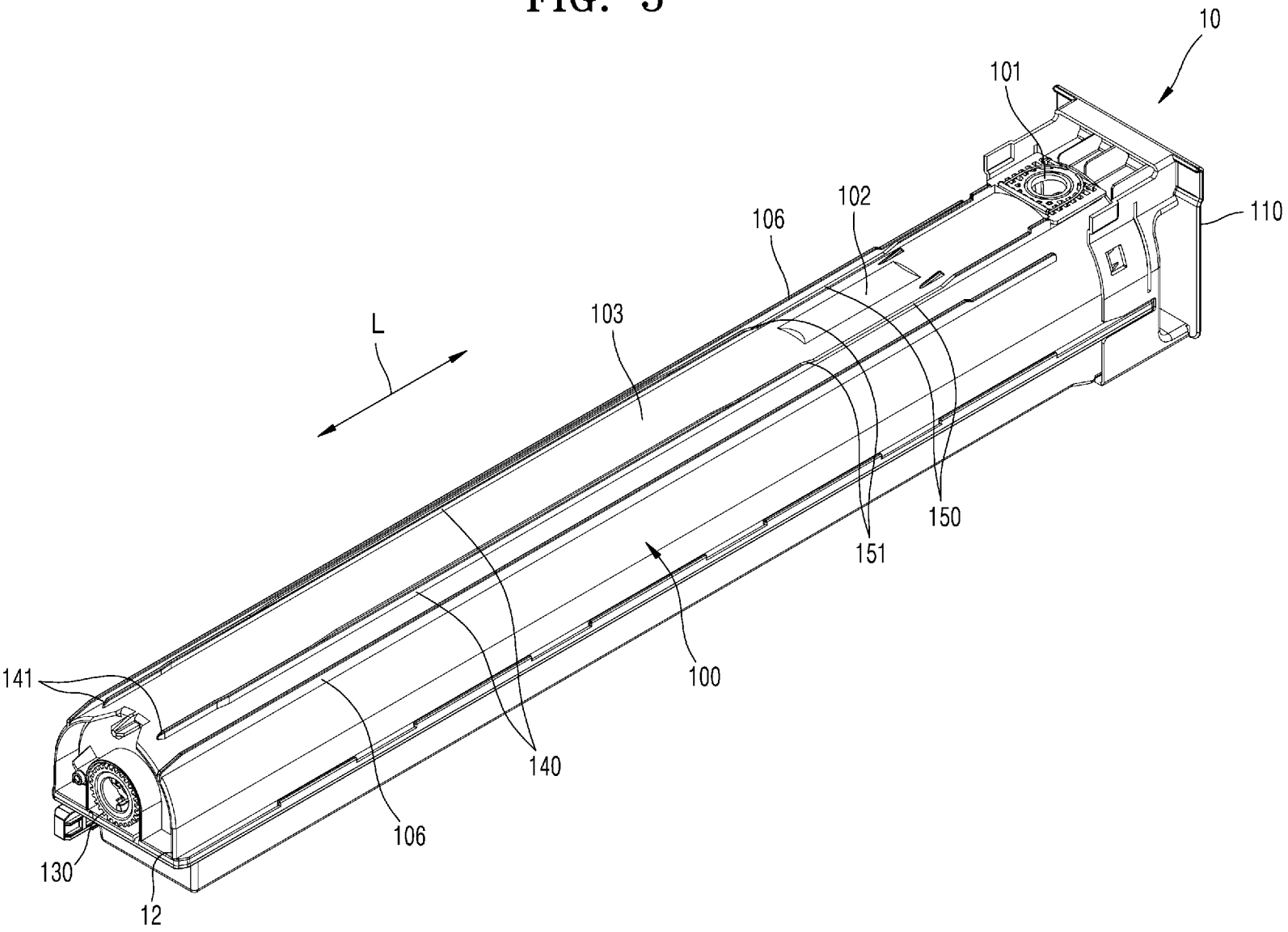
FIG. 5 is a bottom perspective view of a developer cartridge, according to an example.
Figure 6:
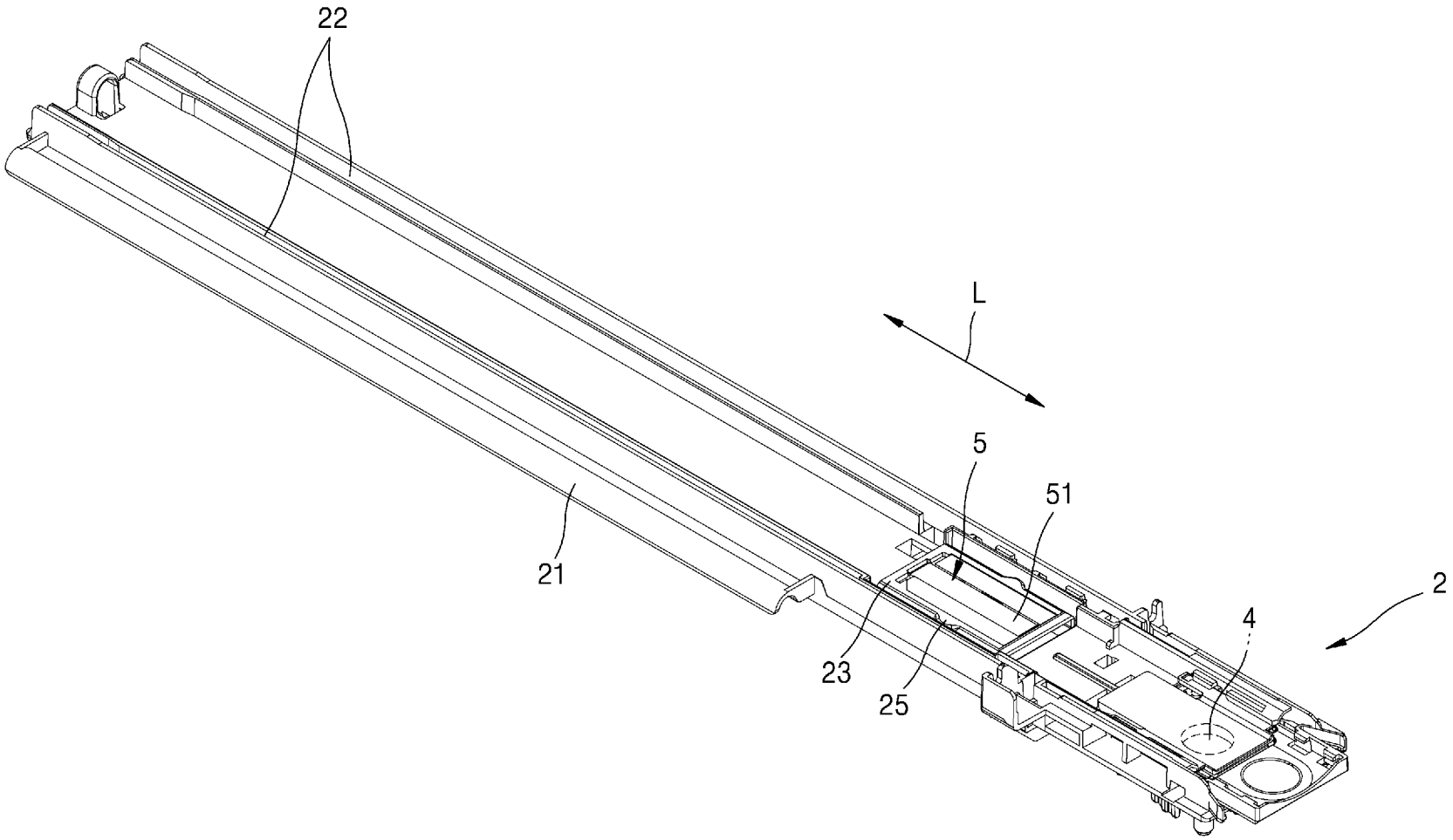
FIG. 6 is a perspective view of a mounting portion, according to an example.

If the developer level sensor 5 interferes with the developer cartridge 10, for example, the housing 100 when the developer cartridge 10 is mounted on the mounting portion 2, damage to the sensing surface 51 of the developer level sensor 5, damage to a structure supporting the developer level sensor 5, or the like may be caused. The developer level sensor 5 may be mounted on the mounting portion 2 to be moved to a separation position for not interfering with the housing 100 of the developer cartridge 10, and to a sensing position close to the sensing portion 102, The sensing position may be a position at which the sensing surface 51 of the developer level sensor 5 is in contact with the sensing portion 102. The sensing position may be a position at which the sensing surface 51 of the developer level sensor 5 is spaced slightly apart from the sensing portion 102. The sensing position may be a position at which the sensing surface 51 of the developer level sensor 5 is spaced slightly apart from the sensing portion 102 while exceeding the outer surface 103-1 of the lower wall 103. The sensing position may be a position at which the sensing surface 51 of the developer level sensor 5 is adjacent to the sensing portion 102 without exceeding the outer surface 103-1 of the lower wall 103. The developer level sensor 5 may be moved to the sensing position and the separation position in conjunction with mounting and separating operations of the developer cartridge 10. The developer cartridge 10 is provided with a structure for preventing interference with the developer level sensor 5 in the process of being mounted on or separated from the mounting portion 2. Hereinafter, an example of a structure for preventing interference between the housing 100 of the developer cartridge 10 and the developer level sensor 5 will be described, FIG. 5 is a bottom perspective view of the developer cartridge 10, according to an example. FIG. 6 is a perspective view of the mounting portion 2, according to an example.

Referring to FIG. 5, an example of the structure for preventing interference between the housing 100 of the developer cartridge 10 and the developer level sensor 5 may include a rib 140 that protrudes from the lower wall 103, extends in the lengthwise direction L, and is provided with a stepped portion 150 having small protrusion at a position corresponding to the sensing portion 102. Protrusion of the stepped portion 150 from the lower wall 103 is less than protrusion of the rib 140 from the lower wall 103. An end portion 141 of the rib 140 toward the rear end portion 12 may have a shape in which protrusion decreases toward the rear end portion 12. For example, the end portion 141 may have a round or chamfered shape. An end portion 151 of the stepped portion 150 toward the rear end portion 12 may have a shape in which protrusion decreases toward the rear end portion 12. For example, the end portion 151 may have a round or chamfered shape. A first mounting guide 106 guides the developer cartridge 10 in the lengthwise direction L when the developer cartridge 10 is mounted on the mounting portion 2.

Referring to FIG. 6, the mounting portion 2 may include a mounting frame 21 having a structure for guiding the developer cartridge 10 such that the developer cartridge 10 is slid in the lengthwise direction L to be mounted on or separated from the mounting portion 2. The mounting frame 21 may be provided with a second mounting guide 22 having a shape complementary to the first mounting guide 106. As an example, the first mounting guide 106 may have a rib shape extending in the lengthwise direction L, and the second mounting guide 22 may have a rail shape extending in the lengthwise direction L.

The developer level sensor 5 is mounted on a sensor holder 23 such that the sensing surface 51 faces the sensing portion 102. The sensor holder 23 is mounted on the mounting portion 2 to be able to be moved to the sensing position and the separation position. The sensor holder 23 may be installed on the mounting frame 21 to be able to approach or be separated from the developer cartridge 10. An elastic member 24 applies an elastic force to the sensor holder 23 in a direction to move to the sensing position. The elastic member 24 may be implemented with, for example, a spring such as a compression coil spring supported between the sensor holder 23 and the mounting frame 21, or the like.

The sensor holder 23 is provided with an interferer 25. The interferer 25 may be located on an outer side of the developer level sensor 5, and may be in a rib shape extending in the lengthwise direction L. In the case where the developer cartridge 10 is mounted on the mounting portion 2, the interferer 25 may interfere with the rib 140 protruding from the lower wall 103 of the housing 100 to be pressed in a direction opposite the elastic force of the elastic member 24. When the mounting of the developer cartridge 10 is completed, the interferer 25 may face the stepped portion 150, and the sensor holder 23 may be returned to the sensing position by the elastic force of the elastic member 24. In the case where the developer cartridge 10 is removed from the mounting portion 2, the interferer 25 may interfere with the end portion 151 of the stepped portion 150, and may be pressed in a direction opposite the elastic force of the elastic member 24 by the rib 140. Accordingly, the sensor holder 23 is moved from the sensing position to the separation position. Since the end portion 141 of the rib 140 toward the rear end portion 12 has a chamfered or round shape, when the developer cartridge 10 is mounted on the mounting portion 2, the rib 140 and the interferer 25 may interfere smoothly with each other. In addition, since the end portion 151 of the stepped portion 150 toward the rear end portion 12 has a chamfered or round shape, the sensor holder 23 may be smoothly moved from the separation position to the sensing position or vice versa.

Figure 7:
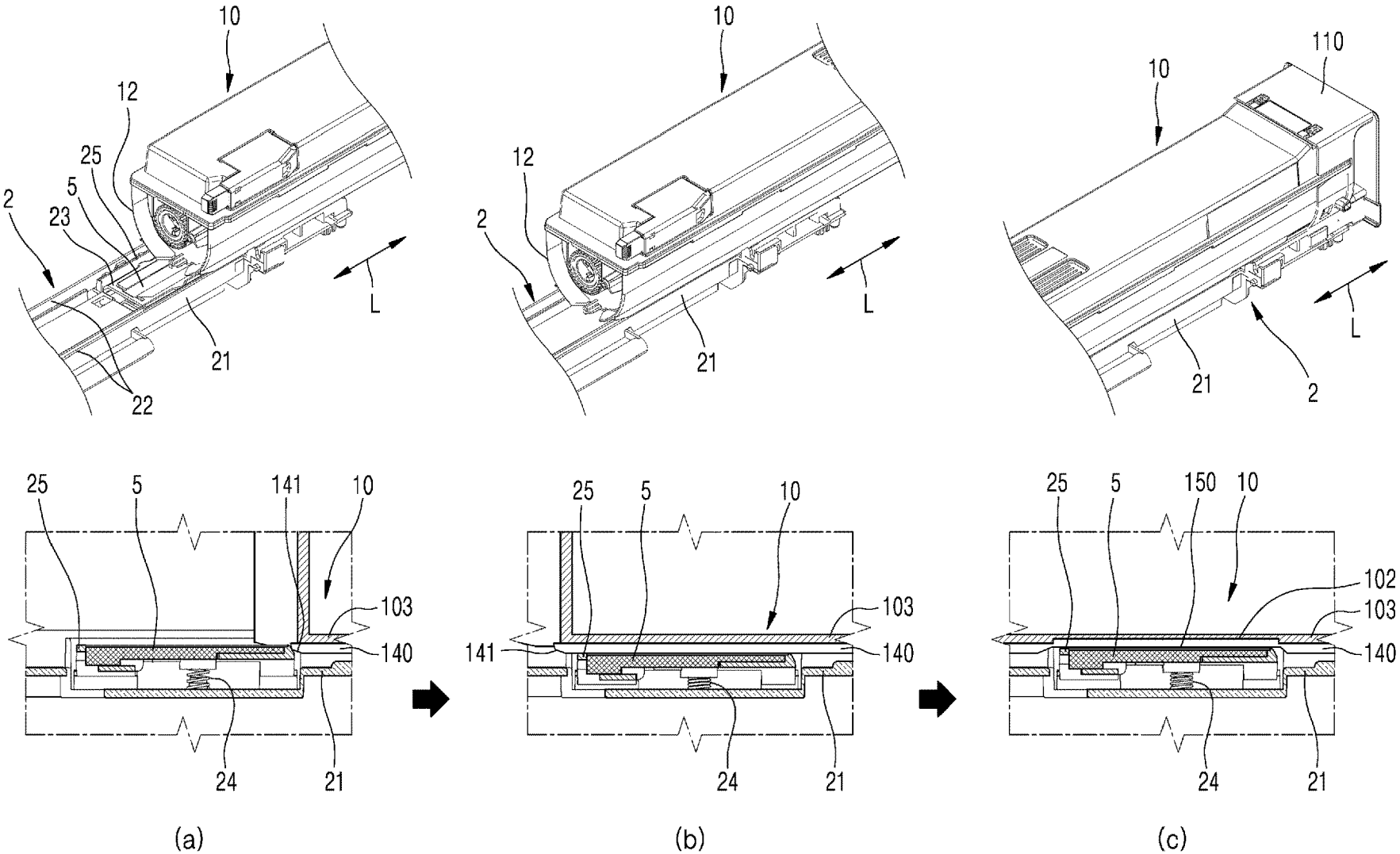
FIG. 7 shows perspective and cross-sectional views illustrating an example of a process in which a developer level sensor is moved to a sensing position and a separation position in conjunction with mounting and separation operations of a developer cartridge.

FIG. 7 shows perspective and cross-sectional views illustrating an example of a process in which the developer level sensor 5 is moved to a sensing position and a separation position in conjunction with mounting and separation operations of the developer cartridge 10. Referring to (a) of FIG. 7, the sensor holder 23 is located at the sensing position by an elastic force of the elastic member 24. If the rear end portion 12 of the developer cartridge 10 is aligned with the entrance of the mounting portion 2, and the developer cartridge 10 is pushed in the lengthwise direction L, the end portion 141 of the rib 140 may interfere with the interferer 25. As illustrated in (b) of FIG. 7, the sensor holder 23 is pressed in a direction opposite the elastic force of the elastic member 24 by the rib 140, and the developer level sensor 5 is located at the separation position separated from the developer cartridge 10. Contact between the rib 140 and the interferer 25 continues, and the developer level sensor 5 is located at the separation position until the mounting of the developer cartridge 10 is completed. Accordingly, contact between the sensing surface 51 of the developer level sensor 5 and the developer cartridge 10 may be prevented. As illustrated in (c) of FIG. 7, when the developer cartridge 10 reaches a mounting position, the contact between the rib 140 and the interferer 25 may end, and the stepped portion 150 and the interferer 25 may face each other. Protrusion of the stepped portion 150 from the lower wall 103 of the housing 100 is less than protrusion of the rib 140. Therefore, the sensor holder 23 is moved toward the developer cartridge 10 by the elastic force of the elastic member 24, and the developer level sensor 5 is located at the sensing position.

In order to separate the developer cartridge 10, if the developer cartridge 10 is pulled in the lengthwise direction L in a state as illustrated in FIG. 7(*c*), the interferer 25 may be in contact with the end portion 151 of the stepped portion 150, and the sensor holder 23 may be pressed in a direction opposite the elastic force of the elastic member 24. As illustrated in (b) of FIG. 7, the interferer 25 interferes with the rib 140, and the sensor holder 23 may be located at the separation position separated from the developer cartridge 10. When the separating of the developer cartridge 10 ends, the contact between the rib 140 and the interferer 25 may end, and the sensor holder 23 may be returned to the sensing position by the elastic force of the elastic member 24.

Figure 8:
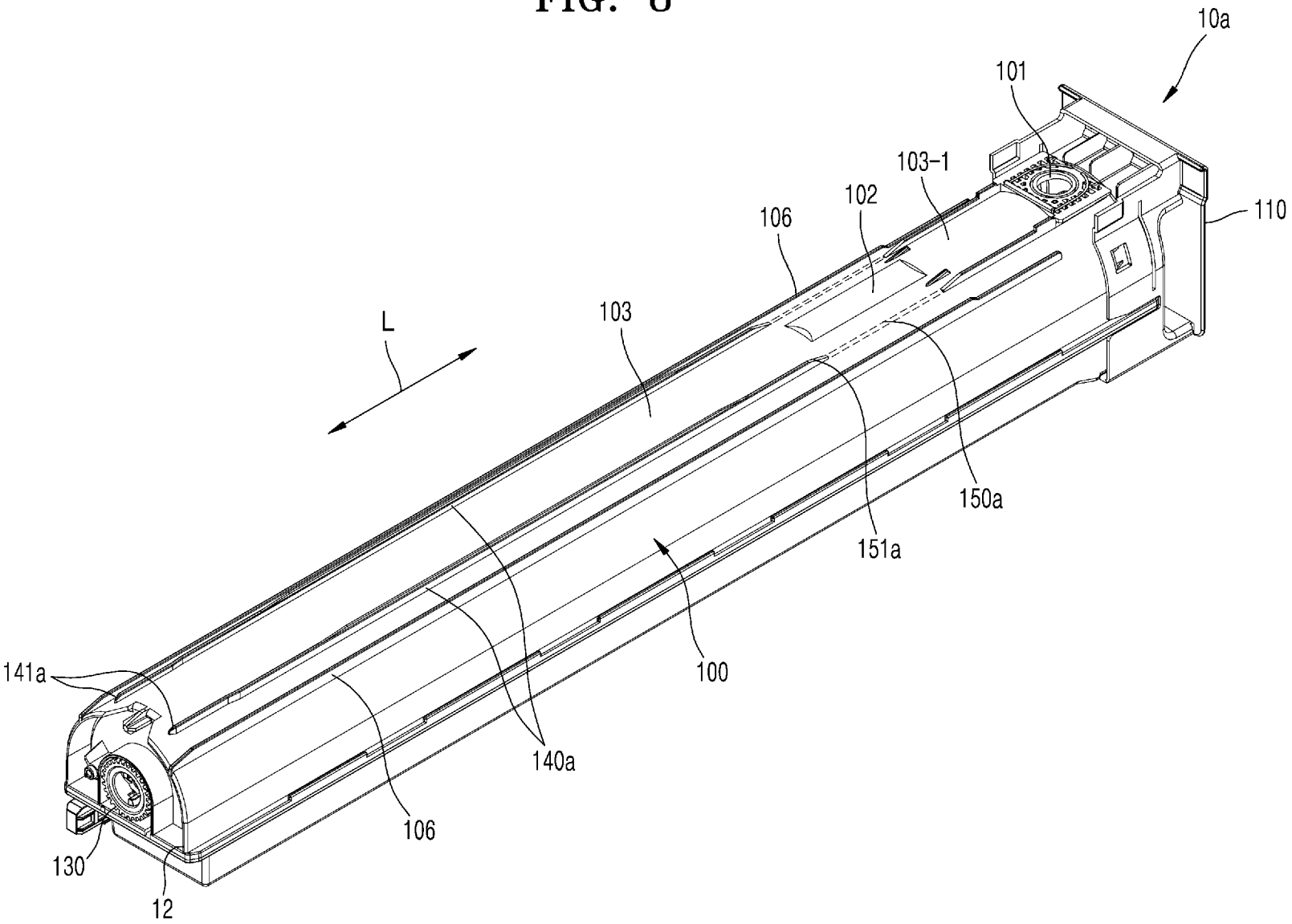
FIG. 8 is a bottom perspective view of a developer cartridge, according to another example.

FIG. 8 is a bottom perspective view of a developer cartridge 10*a*, according to an example. The developer cartridge 10*a* illustrated in FIG. 8 differs in a shape of a rib 140*a* from the developer cartridge 10 illustrated in FIGS. 2 to 7, Hereinafter, differences between the developer cartridge 10*a* and the developer cartridge 10 will be briefly described. Referring to FIG. 8, an example of a structure for preventing interference may include the rib 140*a* that protrudes from the lower wall 103, extends in the lengthwise direction L, and is provided with a stepped portion 150*a* having small protrusion at a position corresponding to the sensing portion 102. The rib 140*a* extends in the lengthwise direction L from a position close to the rear end portion 12 that is first inserted into the mounting portion 2 toward the front end portion 11 beyond the sensing portion 102. The stepped portion 150*a* having small protrusion from the lower wall 103 is provided at the position corresponding to the sensing portion 102. The stepped portion 150*a* according to the present example differs from the stepped portion 150 of the developer cartridge 10 illustrated in FIG. 5 in that the stepped portion 150*a* does not protrude from the lower wall 103. That is, the stepped portion 150*a* has the same surface as the outer surface 103-1 of the lower wall 103. The end portion 141*a* of the rib 140*a* toward the rear end portion 12 may have a chamfered or round shape. One end portion 151*a* of the stepped portion 150*a* toward the rear end portion 12 may have a chamfered or round shape.

Figure 9:
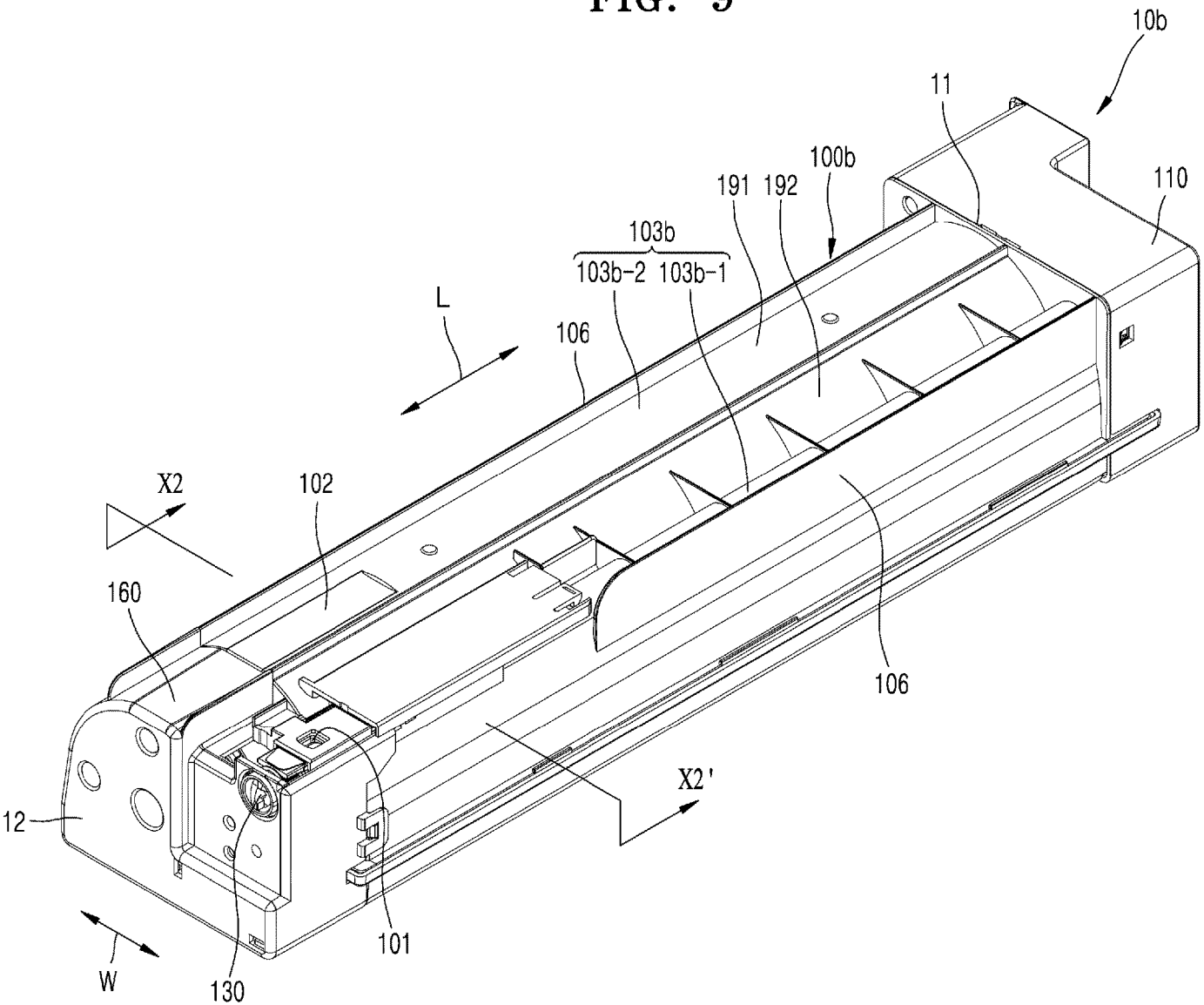
FIG. 9 is a bottom perspective view of a developer cartridge, according to another example.
Figure 10:
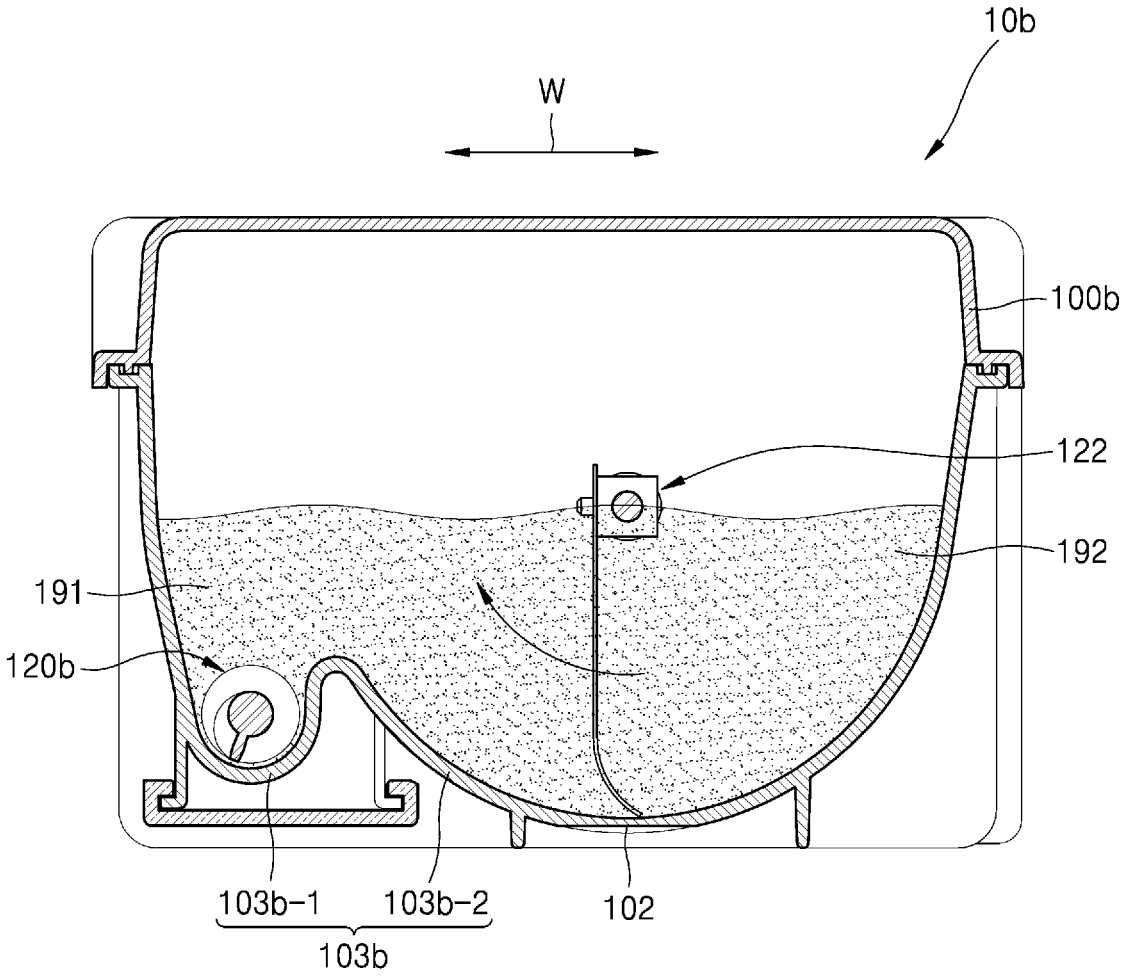
FIG. 10 is a cross-sectional view taken along line X2-X2' in the example of FIG. 9.

FIG. 9 is a bottom perspective view of a developer cartridge 10*b*, according to an example, FIG. 10 is a cross-sectional view taken along line X2-X2' of the example in FIG. 9. The developer cartridge 10*b* according to the present example differs from the developer cartridge 10 and the developer cartridge 10*a* according to examples described above in that the developer outlet 101 is located adjacent to the rear end portion 12, and the sensing portion 102 is located on one side in a lateral direction W of the developer outlet 101. Hereinafter, differences will be mainly described.

Referring to FIGS. 9 and 10, a housing 100*b* of the developer cartridge 10*b* may include a first region 191 and a second region 192 arranged in the lateral direction W. The lateral direction W is a direction orthogonal to the lengthwise direction L. The developer outlet 101 is located in the first region 191 to be adjacent to the rear end portion 12. A transport member 120*b* is installed in the first region 191 to transport a developer in the lengthwise direction L. A second transport member 122 is provided in the second region 192 to transport the developer in the lateral direction W to transfer the developer to the first region 191. As an example, the transport member 120*b* may include an auger including a rotation axis extending in the lengthwise L, and a spiral wing formed on an outer circumference of the rotation axis. The second transport member 122 may include a paddle including a rotation axis extending in the lengthwise direction L, and a transport wing extending in a radial direction from the rotation axis. The developer of the second region 192 is transferred to the first region 191 by the second transport member 122. The transport member 120*b* transfers the developer in the first region 191 in the lengthwise direction L toward the developer outlet 101. The transport member 120*b* transports the developer in the first region 191 from the front end portion 11 toward the rear end portion 12.

The sensing portion 102 is located on one side of the developer outlet 101 in the lateral direction W and an upstream side of the developer outlet 101 based on a direction in which the developer is transferred by the transport member 120*b*. A distance from the rear end portion 12 to the sensing portion 102 does not exceed ½ of a length of the housing 100*b* in the lengthwise direction L. As an example, the distance from the rear end portion 12 to the sensing portion 102 may be less than or equal to ⅓ of the length of the housing 100*b* in the lengthwise direction L. As an example, the distance from the rear end portion 12 to the sensing portion 102 may be less than or equal to ¼ of the length of the housing 100*b* in the lengthwise direction L. A location of the sensing portion 102 may be appropriately determined to be able to detect whether or not the developer inside the housing 100*b* is running out when the developer inside the housing 100*b* has almost run out. The sensing portion 102 is located in the second region 192. A lower wall 103*b* of the housing 100*b* may include a lower wall 103*b*-1 of the first region 191 and a lower wall 103*b*-2 of the second region 192. The sensing portion 102 is recessed into the lower wall 103*b*-2. Both the lower wall 103*b*-1 and the lower wall 103*b*-2 may be in a round shape. For example, the lower wall 103*b*-1 may have an arc shape centered on the rotation axis of the transport member 120*b*. The lower wall 103*b*-2 may have an arc shape centered on the rotation axis of the second transport member 122. The sensing portion 102 may have a flat surface recessed into the lower wall 103*b*-2.

The developer cartridge 10*b* is inserted into the mounting portion 2 from the rear end portion 12. As a structure to prevent interference between the developer cartridge 10*b* and the developer level sensor 5 provided on the mounting portion 2, the developer cartridge 10*b* may include a recessed portion 160 that extends from the sensing portion 102 to the rear end portion 12 and is recessed into the lower wall 103*b*. A recession depth of the recessed portion 160 may be greater than or equal to a recession depth of the sensing portion 102. According to such a configuration, interference between the developer cartridge 10*b* and the developer level sensor 5 may be prevented in the process of mounting the developer cartridge 10*b* on the mounting portion 2.

Figure 11:
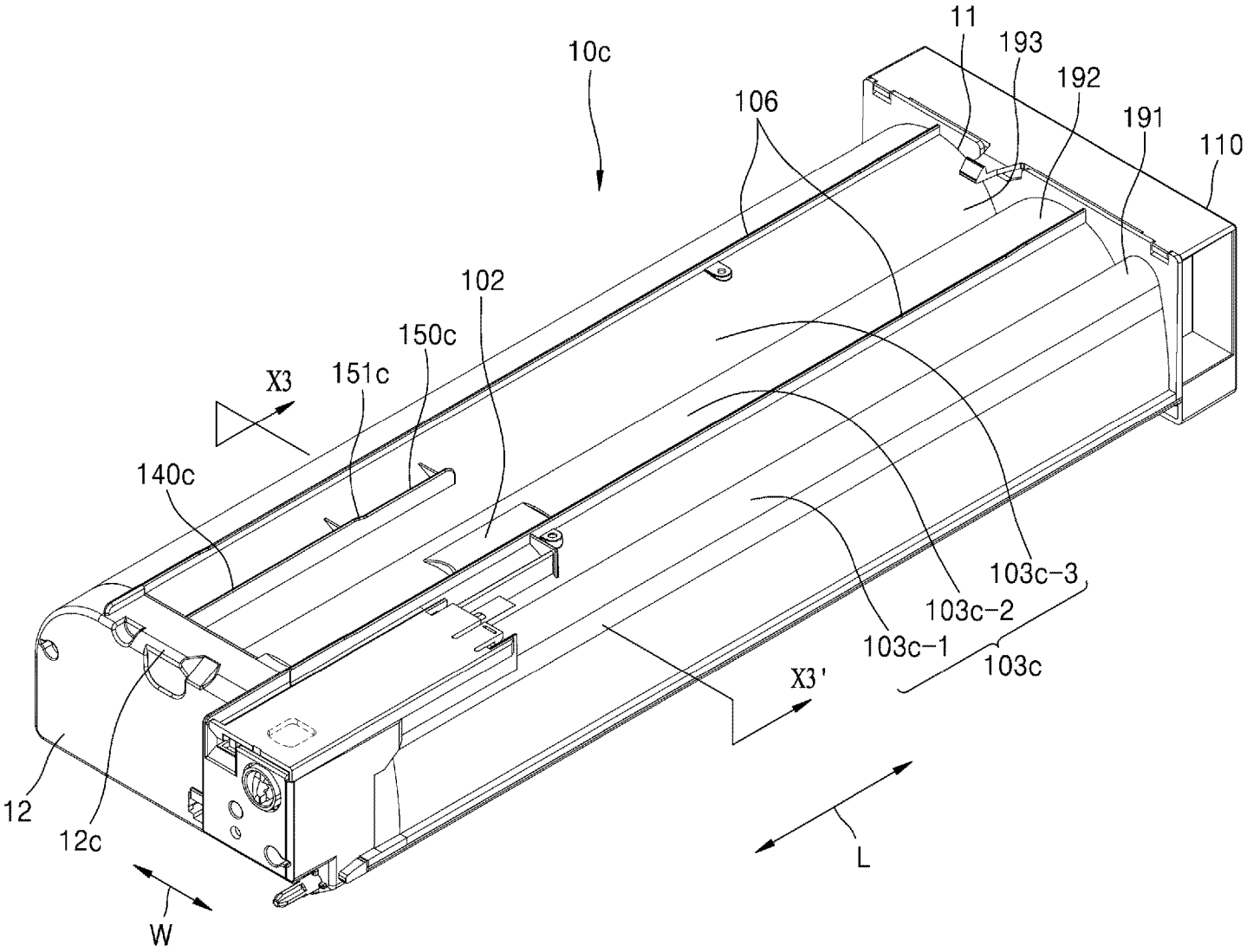
FIG. 11 is a bottom perspective view of a developer cartridge, according to another example.
Figure 12:
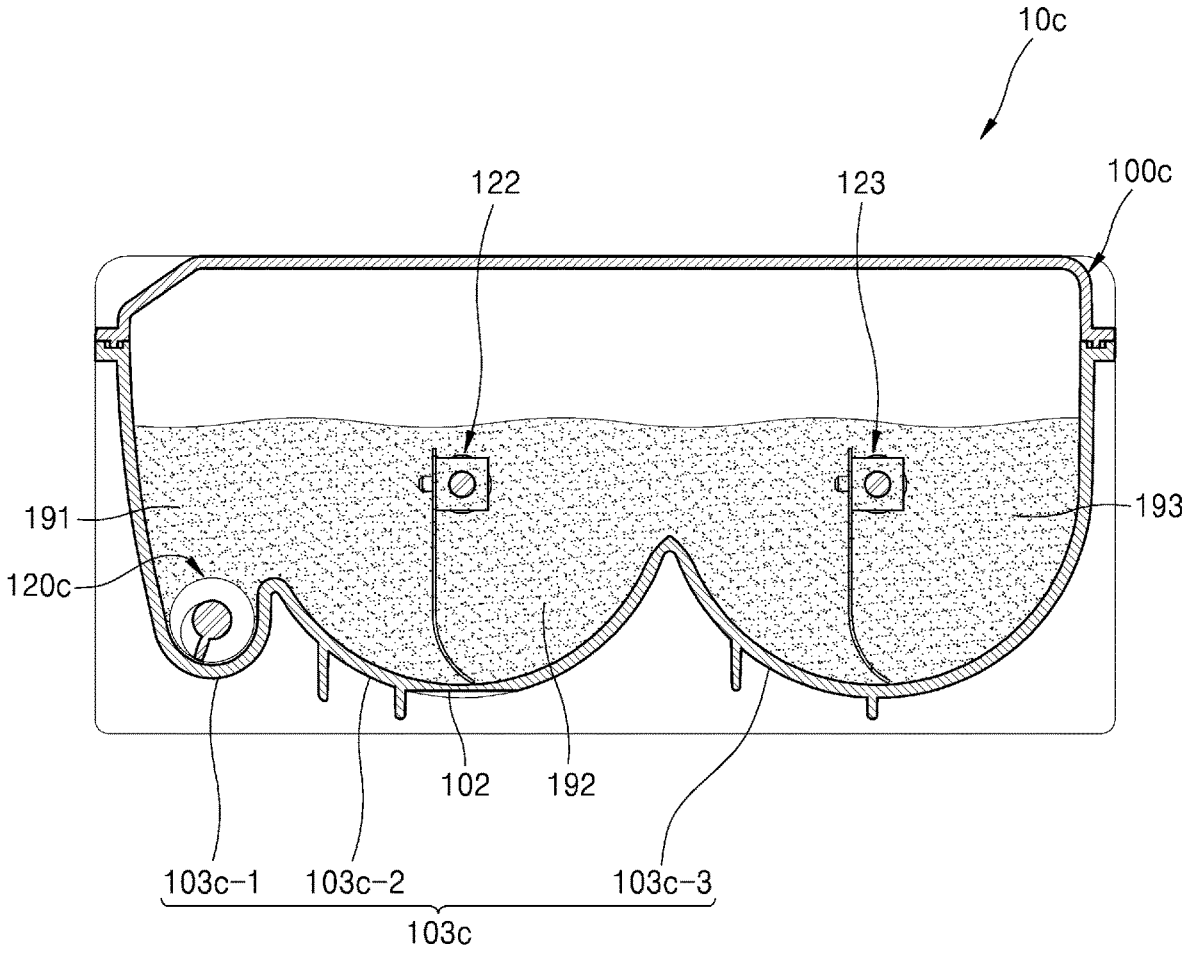
FIG. 12 is a cross-sectional view taken along line X3-X3' in the example of FIG. 11.

FIG. 11 is a bottom perspective view of a developer cartridge 10*c*, according to an example. FIG. 12 is a cross-sectional view taken along line X3-X3' of the example in FIG. 11. The developer cartridge 10*c* according to the present example differs from the developer cartridge 10*b* illustrated in FIGS. 9 and 10 in that the developer cartridge 10*c* has employed a rib structure to prevent interference with the developer level sensor 5. Hereinafter, differences will be mainly described.

Referring to FIGS. 11 and 12, a housing 100*c* of the developer cartridge 10*c* may include the first region 191, the second region 192, and a third region 193 sequentially located in the lateral direction W. The lateral direction W is a direction orthogonal to the lengthwise direction L. The developer outlet 101 is located in the first region 191 to be adjacent to the rear end portion 12. A transport member 120*c* is installed in the first region 191 to transfer a developer in the lengthwise direction L, The second region 192 and the third region 193 are provided with the second transport member 122 and a third transport member 123, respectively, to transport the developer in the lateral direction W. As an example, the transport member 120*c* may be an auger including a rotation axis extending in the lengthwise direction L and a spiral wing formed on an outer circumference of the rotation axis. The second transport member 122 and the third transport member 123 may be a paddle including a rotation axis extending in the lengthwise direction L and a transport wing extending in a radial direction from the rotation axis. The developer in the third region 193 is transferred to the second region 192 by the third transport member 123. The developer in the second region 192 is transferred to the first region 191 by the second transport member 122. The transport member 120*c* transfers the developer in the first region 191 in the lengthwise direction L toward the developer outlet 101. The transport member 120*c* transports the developer in the first region 191 from the front end portion 11 toward the rear end portion 12.

The sensing portion 102 is located on one side of the developer outlet 101 in the lateral direction W and an upstream side of the developer outlet 101 based on a direction in which the developer is transferred by the transport member 120*c*. A location of the sensing portion 102 may be properly determined to be able to detect whether or not the developer inside the housing 100*c* is running out when the developer inside the housing 100*c* has almost run out. The sensing portion 102 is located in the second region 192. A lower wall 103*c* of the housing 100*c* may include a lower wall 103*c*-1 of the first region 191, a lower wall 103*c*-2 of the second region 192, and a lower wall 103*c*-3 of the third region 193. The sensing portion 102 is recessed into the lower wall 103*c*-2 of the second region 102. The lower walls 103*c*-1, 103*c*-2, and 103*c*-3 may all have a round shape. For example, the lower walls 103*c*-1, 103*c*-2, and 103*c*-3 may be in an arc shape centered on the rotation axes of the transport member 120*c*, the second transport member 122, and the third transport member 123, respectively. The sensing portion 102 may have a flat surface recessed into the lower wall 103*c*-2.

The developer cartridge 10*c* is inserted into the mounting portion 2 from the rear end portion 12. The rib structure illustrated in FIG. 5 or 8 is employed to prevent interference between the developer cartridge 10*c* and the developer level sensor 5 provided on the mounting portion 2. Referring to FIG. 11, an example of a structure for preventing interference may include a rib 140*c* that protrudes from the lower wall 103*c*-2, extends in the lengthwise direction L, and is provided with a stepped portion 150*c* having small protrusion at a position corresponding to the sensing portion 102. The rib 140*c* extends in the lengthwise direction L from a position close to the rear end portion 12 that is first inserted into the mounting portion 2 toward the front end portion 11 beyond the sensing portion 102. The stepped portion 150*c* having small protrusion from the lower wall 103*c*-2 is provided at a position corresponding to the sensing portion 102. One end portion of the rib 140*c* toward the rear end portion 12 may have a shape in which protrusion gradually decreases toward the rear end portion 12. According to the present example, an inclined portion 12*c* is provided at the rear end portion 12, and the inclined portion 12*c* serves as one end portion of the rib 140*c* toward the rear end portion 12. An end portion 151*c* of the stepped portion 150*c* toward the rear end portion 12 may have a shape in which protrusion gradually decreases toward the front end portion 11. For example, the end portion 151*c* may be in a chamfered or round shape.

Although not shown, the rib 104*c* according to the present example may have the structure illustrated in FIG. 8. That is, the stepped portion 150*c* may not protrude from the lower wall 103*c*-2.

It should be understood that examples described herein should be considered in a descriptive sense only and not for purposes of limitation. Descriptions of features or aspects within each example should typically be considered as available for other similar features or aspects in other examples. While one or more examples have been described with reference to the figures, it will be understood by those of ordinary skill in the art that various changes in form and details may be made therein without departing from the spirit and scope as defined by the following claims.

What is claimed is:

1. A developer cartridge comprising:

a housing to accommodate a developer and including a developer outlet; and a sensing portion that forms a sensing area to detect a developer level inside of the housing, and is recessed into a portion of a lower wall of the housing accordingly having a thickness less than a thickness of a remaining portion of the lower wall.

2. The developer cartridge of claim 1, wherein a cross-sectional shape of the lower wall orthogonal to a lengthwise direction of the housing is a round shape.

3. The developer cartridge of claim 1, wherein the sensing portion is flat.

4. The developer cartridge of claim 1, further comprising a transport member inside of the housing to transport the developer in a lengthwise direction of the housing toward the developer outlet, wherein the sensing portion is aligned with the developer outlet in the lengthwise direction, and on an upstream side of the developer outlet based on a direction in which the developer is transported by the transport member.

5. The developer cartridge of claim 4, wherein the housing comprises a front end portion and a rear end portion opposite the front end portion in the lengthwise direction, the developer outlet is adjacent to the front end portion, and the transport member to transport the developer from the rear end portion to the front end portion.

6. The developer cartridge of claim 5, further comprising a rib that protrudes from the lower wall, extends in the lengthwise direction, and includes a stepped portion having small protrusion at a position corresponding to the sensing portion.

7. The developer cartridge of claim 6, wherein one end portion of the rib toward the rear end portion has a shape in which the protrusion gradually decreases toward the rear end portion, and one end portion of the stepped portion toward the rear end portion has a shape in which the protrusion decreases toward the front end portion.

8. The developer cartridge of claim 1, wherein the housing comprises a front end portion and a rear end portion opposite the front end portion in the lengthwise direction of the housing, and the sensing portion is on one side in a lateral direction of the developer outlet.

9. The developer cartridge of claim 8, wherein the developer outlet is adjacent to the rear end portion, a transport member is inside the housing to transport the developer from the front end portion to the rear end portion toward the developer outlet, and the sensing portion is on an upstream side of the developer outlet based on a direction in which the developer is transported by the transport member.

10. The developer cartridge of claim 9, wherein the housing comprises a first region and a second region arranged in the lateral direction, the transport member and the developer outlet are arranged in the first region, and the sensing portion is in the second region.

11. The developer cartridge of claim 10, wherein a second transport member is in the second region to transport the developer in the lateral direction to transfer the developer to the first region.

12. The developer cartridge of claim 11, further comprising a recessed portion that extends from the sensing portion to the rear end portion and is recessed into the lower wall.

13. A developer cartridge comprising:

a housing to accommodate a developer and comprising a lower wall and a developer outlet on the lower wall, wherein a cross-sectional shape of the lower wall orthogonal to a lengthwise direction is a round shape;

a transport member inside the housing to transport the developer in the lengthwise direction toward the developer outlet; and a sensing portion that forms a sensing area on an upstream side of the developer outlet based on a direction in which the developer is be transported by the transport member to detect whether or not the developer inside the housing is running out, the sensing portion being recessed into a portion of the lower wall accordingly having a thickness less than a thickness of a remaining portion of the lower wall.

14. The developer cartridge of claim 13, further comprising a rib that protrudes from the lower wall, extends in the lengthwise direction, and includes a stepped portion having small protrusion at a position corresponding to the sensing portion.

15. The developer cartridge of claim 13, wherein the housing includes a front end portion and a rear end portion opposite the front end portion in the lengthwise direction, the developer outlet is adjacent to the rear end portion, the sensing portion is on one side of the developer outlet in a lateral direction, and a recessed portion that extends from the sensing portion to the rear end portion, and is recessed into the lower wall.

* * * * *